United States Patent [19]

Melia

[11] Patent Number: 4,872,387

[45] Date of Patent: Oct. 10, 1989

[54] WIND-ACTUATED MUSICAL DEVICE

[76] Inventor: John Melia, P.O. Box 471, Woodstock, N.Y. 12498

[21] Appl. No.: 185,879

[22] Filed: Apr. 25, 1988

[51] Int. Cl.[4] ..... G10F 1/06
[52] U.S. Cl. ..... 84/95.2
[58] Field of Search ..... 84/94.2, 95.2, 94.1, 84/95.1

[56] References Cited

U.S. PATENT DOCUMENTS 2,495,365 1/1950 Cohn ..... 84/94.2
4,466,327 8/1984 Hinton ..... 84/95.2

FOREIGN PATENT DOCUMENTS 15746 12/1897 Switzerland ..... 84/94.2
10408 of 1891 United Kingdom ..... 84/95.2

*Primary Examiner*—L. T. Hix
*Assistant Examiner*—Brian W. Brown

[57] ABSTRACT

A musical device using a wind-driven impeller to actuate a musical movement.

5 Claims, 2 Drawing Sheets

WIND-ACTUATED MUSICAL DEVICE

BACKGROUND OF THE INVENTION

Musical movements are well-known devices and have been incorporated in a wide variety of applications such as music boxes, toys and amusements. Also well-known are wind-chimes which produce a melodious sound when the wind causes the chimes to be struck.

A musical movement which is wind-powered produces a specific melody unlike the wind chimes which produce random sounds depending on chance as to how the chimes are struck. By using an ornate impeller or enclosure, an attractive device is created which makes a pleasing musical sound. By the rate at which the music is played, the wind speed is also indicated. If a vane is included, the device also indicates the direction of the wind.

SUMMARY OF THE INVENTION

In accordance with this invention a musical movement is used which includes a member, which is rotatably mounted on a chassis. Pins are mounted in specific positions on the surface of the rotatable member. A sounding plate, including tines, is located adjacent the rotatable member so the tines are struck by the pins as the rotatable member turns. A driveshaft on which an impeller is mounted is coupled to the rotatable member. In this manner, as the wind rotates the impeller, the rotatable member is turned, and the sounding plate produces a melody. The device may include a vane which will align with the wind. The musical movement may be mounted with an enclosure to protect it. If a vane is used, the device includes a support means which permits the rotation of the device for alignment with the wind.

DETAILED DESCRIPTION OF THE DRAWINGS

DETAILED DESCRIPTION OF THE INVENTION

Figure 1:
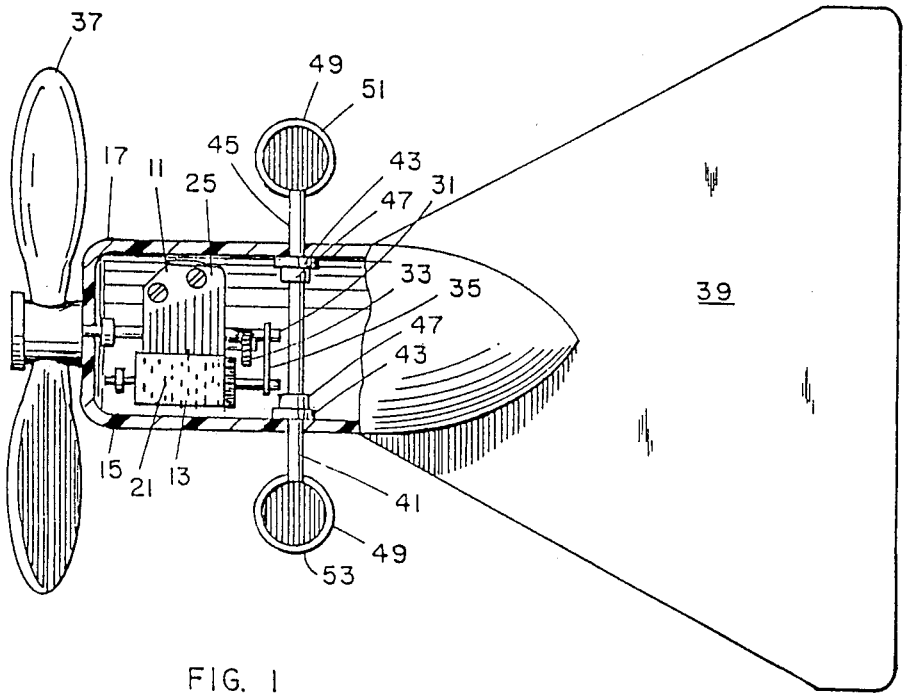
FIG. 1 is a side elevation of the device partially broken away, including a vane to align the device with the wind's direction and using a rotable rod for suspending the device.

All versions of the device, in accordance with this invention utilize a musical movement 11. The musical movement 11 includes a member 13, generally cylindrical, which is rotatably mounted on a mounting means 15, which according to the preferred embodiment is a chassis 17. The rotatable member 13 has pins 21 mounted on it's outer surface 23, which are specifically located depending upon the particular melody to be produced. Mounted adjacent the rotatable member 13 is a sounding plate 25 having a plurality of tines 27, each of which may produce a different tone. The sounding plate 25 is so located in relationship to the rotatable member 13 that as the rotatable member 13 is made to rotate, the pins 21 strike corresponding tines 27 of the sounding plate 25, thereby producing the desired sequence of musical sounds. The musical movement 11 also includes a driveshaft 29 and a drive mechanism 31 which couples the driveshaft 29 to the rotatable member 13. The drive mechanism 31 is preferably a set of gears 33 designed to reduce the speed of rotation of the rotatable member 13 relative to the speed of the driveshaft 29. As seen in FIG. 1, the driveshaft 29 and drive mechanism 31 include journals 35 for rotatable mounting.

The driveshaft 29 extends outwardly from the musical movement 11, and an impeller 37 is mounted on the driveshaft 29, so that air, which is moving relative to the impeller 37, causes the impeller 37 to rotate about it's axis, thus producing the melody as explained previously.

Referring now to FIG. 1, an embodiment of the invention is shown which uses a vane 39. The vane 39 maintains the impeller 37 into the wind at all times. As a result, the device further serves as a weathervane indicating the wind direction.

The vane 39, as shown in FIG. 1, has a generally triangular shape and is a flat plate symmetrical along it's horizontal axis and extending upwardly and downwardly from the horizontal axis of the vane 39 at the end of the vane 39, which is the end most remote from the impeller 37. However, other embodiments may use vanes 39, which are three-dimensional.

The musical movement is mounted so that the driveshaft 29 extends forward of the vane 39. The impeller 37 is mounted on the end of the driveshaft 29 forward of the vane 39. The impeller 37 is of a standard design, but impellers 37 with other designs, including more ornamental designs, can be used, such as a pinwheel.

The embodiment shown in FIG. 1 has a support means 41 to permit the vane 19 to move in a complete circle in the horizontal plane. A pair of support journals 43 are affixed to the device and a rod 45 is supported rotatably in the support journals 43. A pair of collars 47 affixed to the rod 45 adjacent to the support journals 43 prevents the device from moving along the rod 45 in either direction. Rings 49 are affixed to both ends of the rod 45. The upper ring 51 is used to suspend the device by means of a rope, chain, or cable from any suitable support and the lower ring 53 may be affixed to another suitable support by means of a rope, chain or cable, or a weight may be suspended from the lower ring 53 to stabilize the device in the wind. Additionally, the rings 49 may be removed to permit the device to be mounted on a pole or handle (not shown). A bracket (not shown) may be mounted on the pole handle or on the device itself to attach the device to a stroller, a cycle or similar unit.

Figure 2:
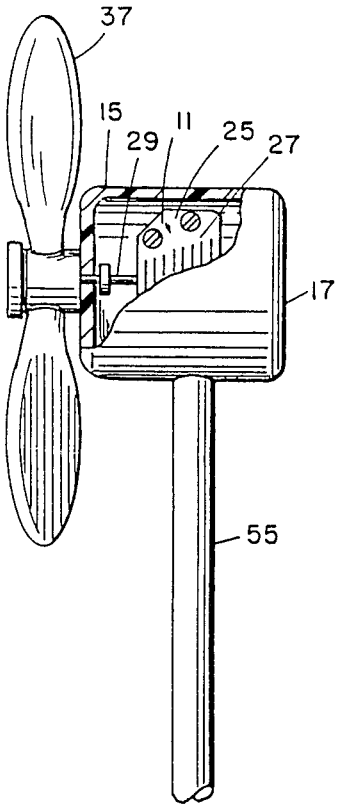
FIG. 2 is a side elevation of a simplified version of the device partially broken away to show the musical movement with the device rigidly supported by a handle.

The embodiment shown in FIG. 2 of the drawings is a simplified version of the device shown in FIG. 1, in that the vane 39 is eliminated. This embodiment (FIG. 2) is intended for use as a hand-held device, and thus is supported on a handle 55 which is rigidly affixed to the chassis 17 of the device in any suitable manner.

Figure 4:
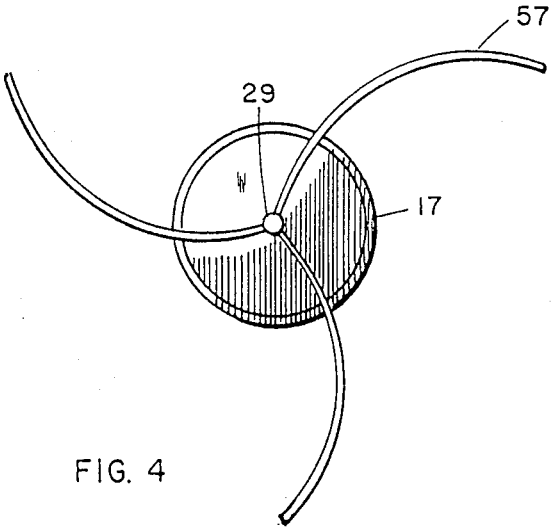
FIG. 4 is a top plan view of the version of the device shown in FIG. 3, showing the configuration of the impeller.
Figure 3:
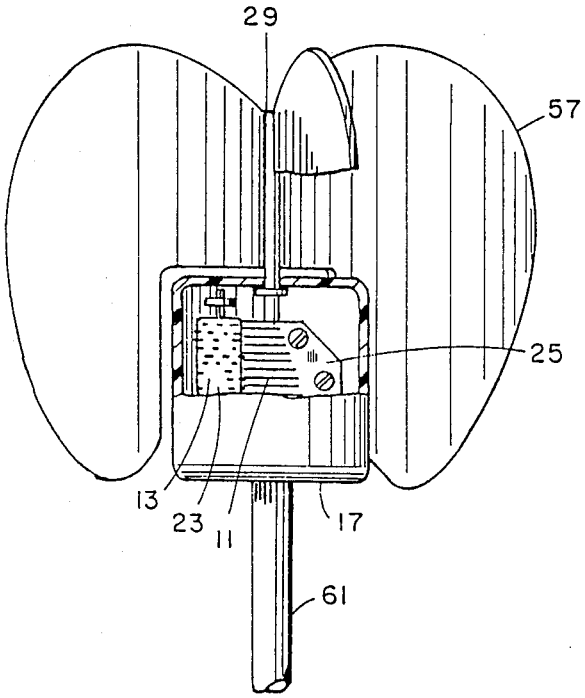
FIG. 3 is a side elevation of a specialized version of the device partially broken away with an omnidirectional impeller and being rigidly supported on a pole.

The embodiment shown in FIG. 3 also does not include a vane 39, but utilizes an omnidirectional impeller 57 which is located in a horizontal plane and not in a vertical plane as are the impellers 37 contemplated by the embodiments shown in FIGS. 1 and 2. The omnidirectional impeller 57, as seen in FIGS. 3 and 4 includes three curved plates 59. Each plate or blade 59 is substantially circular when viewed along a vertical plane but the impeller 57 has a general inverted Ushaped configuration when viewed along the horizontal plane. The lower inside area of the omnidirectional impeller 57 is cut away to permit space for the musical movement and the chassis 17 on which the musical movement 11 is mounted thereby necessitating the U-shape of the impeller 57.

As best seen in FIG. 3, the chassis 17 is rigidly supported on a pole 61 which may be affixed to the ground or the device, by using a clamp (not shown), may be affixed to a carriage or cycle. The pole 61 may also be used as a handle to be hand held. The musical movement is mounted on the chassis 17 and the driveshaft 29 extends vertically upwardly from the chassis 17 and is preferably substantially aligned along a common axis with the pole 61, but the pole 61 and the driveshaft 29 extend from opposite sides of the chassis 17. The impeller 57 is mounted on the driveshaft 29. With the impeller 57 as shown in FIGS. 3 and 4, the impeller 57 will rotate regardless of the wind direction.

While a preferred embodiment has been shown and described, various modifications and substitutions may be made without departing from the spirit and scope of this invention. Accordingly, it is understood that this invention has been described by way of illustration, rather than limitation.

I claim:

1. A wind-actuated musical device to be suspended between a suspension means, said musical device comprising:

a mounting means;

a rotatable member having a surface and being rotatably mounted on the mounting means, the rotatable member having an outer surface, pins being affixed in predetermined positions on the outer surface of the rotatable member;

a sounding plate mounted on the mounting means and including a series of tines mounted adjacent to the rotatable member so as to be struck by the pins as the rotatable member rotates, the tines being adapted to make musical sounds when struck by the pins;

a drive shaft rotatably mounted on the mounting means;

means for connecting the drive shaft to the rotatable member to rotate the rotatable member;

a wind-actuated impeller rigidly affixed to the drive shaft to rotate the drive shaft; and a support means, including a rod rotatably affixed to the mounting means with a ring at each end for connection to the suspension means.

2. A wind-actuated musical device according to claim 1 wherein the rotatable member is a cylinder.

3. A wind-actuated musical device according to claim 1 wherein the mounting means is a chassis.

4. A wind-actuated musical device according to claim 1 wherein the mounting means is a vane and the vane is a flat plate substantially symmetrical along it's horizontal axis.

5. A wind-actuated device according to claim 1 wherein the impeller is located in a vertical plane.

* * * * *